United States Patent [19]

Hosoya et al.

[11] 4,403,403

[45] Sep. 13, 1983

[54] METHOD OF MAKING A FLY BACK TRANSFORMER

[75] Inventors: Mitsuru Hosoya, Fujisawa; Toshio Onodera, Kamakura; Ken Tanimura, Tokyo, all of Japan

[73] Assignee: Sony Corporation, Tokyo, Japan

[21] Appl. No.: 284,102

[22] Filed: Jul. 16, 1981

Related U.S. Application Data

[62] Division of Ser. No. 86,617, Oct. 19, 1979, abandoned.

[30] Foreign Application Priority Data

Oct. 20, 1978 [JP] Japan ..... 53-144832

[51] Int. Cl.[3] ..... H01F 41/00

[52] U.S. Cl. ..... 29/602 R; 29/418; 264/272.19; 264/275; 264/317; 336/96

[58] Field of Search ..... 29/602 R, 605, 418; 336/96, 205, 208, 192, 198; 264/272.19, 275, 317, 313

[56] References Cited

U.S. PATENT DOCUMENTS

| | | | |
|---|---|---|---|
| 2,934,815 | 5/1960 | Stumboch | 29/418 X |
| 3,766,643 | 3/1972 | Arrington et al. | 29/605 |
| 4,179,796 | 12/1979 | Allen | 29/605 |
| 4,246,636 | 1/1981 | Kawamura et al. | 336/96 X |

*Primary Examiner*—Carl E. Hall

*Attorney, Agent, or Firm*—Hill, Van Santen, Steadman & Simpson

[57] ABSTRACT

A fly-back transformer in which its low and high voltage windings are molded integral by resin material is disclosed. In this case, a winding receiving frame having an attaching means is integrally fixed to the peripheral edge portion on the terminal side surface of the molded body.

1 Claim, 5 Drawing Figures

METHOD OF MAKING A FLY BACK TRANSFORMER

This is a division, of application Ser. No. 086,617, filed Oct. 19, 1979 now abandoned.

BACKGROUND OF THE INVENTION

1. Field of the Invention

The present invention relates generally to a fly-back transformer, and is directed more particularly to a fly-back transformer with no case.

2. Description of the Prior Art

In the art, almost all fly-back transformers are constructed such that low voltage and high voltage windings are wound on the outer periphery of a core, the windings are housed in a case through which the core passes, and insulating material is introduced into the case to integrate the windings with the case. With the so-called prior art fly-back transformer with a case, the windings wound on the core are accommodated in the case as described above, so that the positioning of the windings relative to the case can be achieved correctly and there is no need to treat the end surface thereof by charging the insulating material into the case below its edge. However, since the prior aft fly-back transformer uses a case, it can not be made compact and its size becomes large. Further, upon manufacturing the prior art fly-back transformer, both the case making process and the charging process of the material, which covers the windings, into the case can not be carried out simultaneously and hence the working process requires many steps. Further, the covering of the windings requires two layers, which causes the construction to become complicated.

In the art, there has been proposed a fly-back transformer with no case which is free from the defects inherent to the fly-back transformer with a case. With the prior art fly-back transformer with no case, a low voltage winding and a high voltage winding are wound on a bobbin through which a core passes. The bobbin with both windings is loaded into a molding box, then molded by a resin, and thereafter, the core is inserted into the bobbin to be fixed thereto. Thus, the prior art fly-back transformer with no case is made. In this molding of the windings, however, when the windings are loaded into the molding box and then resin injected into the molding box, the coil bobbin is vibrated or swung by the injection pressure of resin. As a result, the winding bobbin becomes eccentric with respect to the molding box. If the molding of the winding bobbin is carried out with the above eccentric state, the products are poor in quality and hence low in yield. Further, with this molding, the resin material swells up along the peripheral surface of the molding box by a capillary phenomenon. This swelling causes the resin material to protrude from the molded surface as a burr after releasing. This burr causes trouble in treating, that is, attaching the winding bobbin to a machine chassis. Therefore, after molding, a surface treatment is necessary to remove the burr, which increases the manufacturing time.

OBJECTS AND SUMMARY OF THE INVENTION

Accordingly, an object of the present invention is to provide a novel fly-back transformer of the type having no case.

Another object of the invention is to provide a fly-back transformer having no case free from the defects inherent in the prior art.

According to an example of the present invention, a fly-back transformer whose low and high voltage windings are molded integral by resin material is provided, which comprises a winding received frame having attaching means and integrally fixed to a peripheral edge portion on a terminal side surface of the molded body.

The other objects, features and advantages of the present invention will become apparent from the following description taken in conjunction with the accompanying drawings.

DESCRIPTION OF THE PREFERRED EMBODIMENT

An example of the fly-back transformer according to the present invention will be hereinafter described with reference to the attached drawings.

Figure 1:
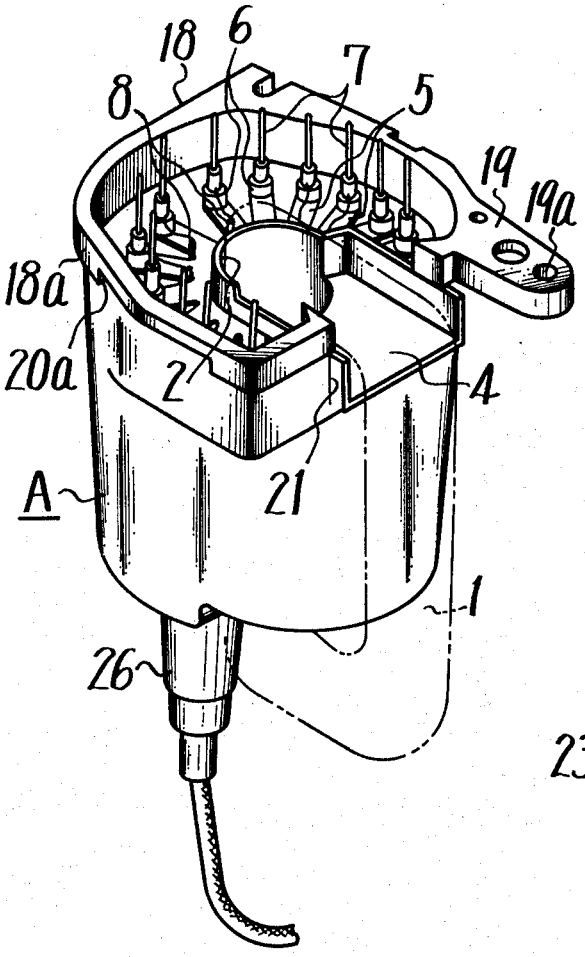
FIG. 1 is a perspective view showing an example of the fly-back transformer according to the present invention.
Figure 2:
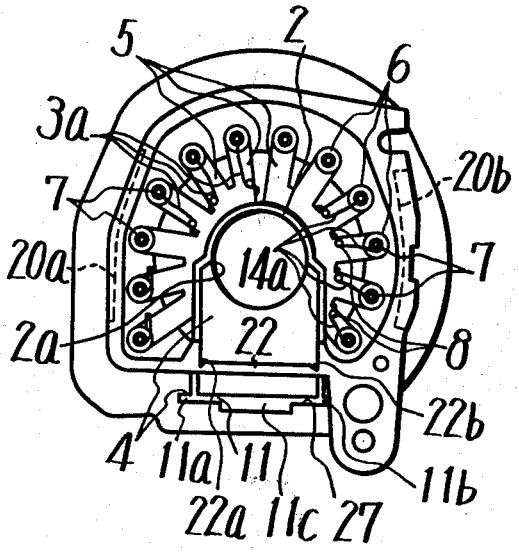
FIG. 2 is its plan view upon molding.
Figure 3:
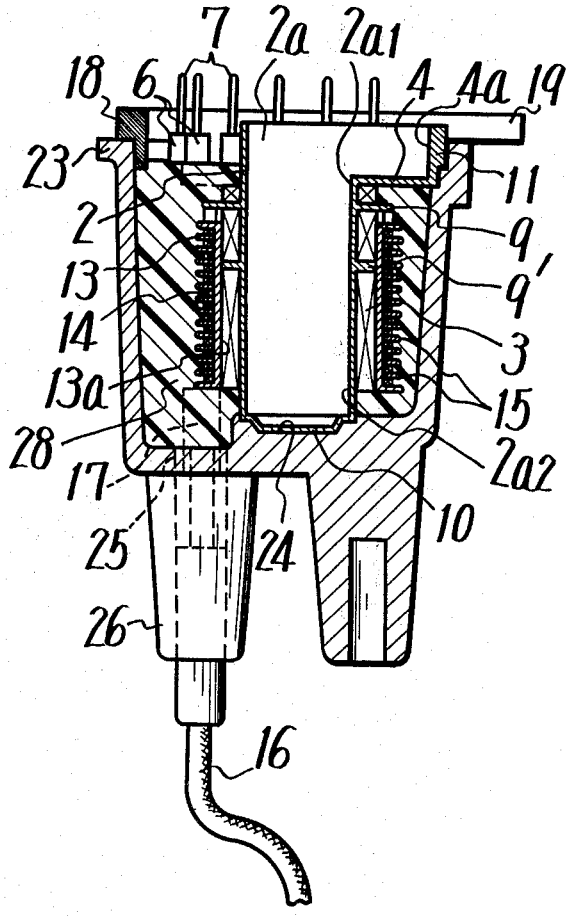
FIG. 3 is a vertical cross-sectional view of the fly-back transformer shown in FIGS. 1 and 2.

In FIGS. 1 to 3, 1 designates a core and 2 a low voltage side bobbin on which a low voltage winding 3 is wound. The bobbin 2 has bored therethrough a hollow center bore **2*a* for receiving the core 1 therein. A core receiving member 4 of a gutter shape is formed integral with the bobbin 2 which is extended horizontally from one of upper opening 2*a*1 of the center bore 2*a*, and a plurality of radial projections 5 are provided from the outer periphery of the opening 2*a*1 of the bobbin 2 except the outer peripheral portion where the core receiving member 4 is formed. A projecting piece 6 is integrally formed on the upper surface at the tip end of each of a plurality of radial projections 5, and a terminal pin 7 is planted on each of the projecting pieces 6. A protrusion 8 is formed on the surface at the base portion of each radial projection 5. Further, a flange 9 is provided along the outer periphery of the bobbin 2 apart from the projections 5, and an engaging projection 9' is formed on the outer periphery of the bobbin 2 below the flange 9. The low voltage winding 3 is wound on the bobbin 2 below the flange 9**.

In order to avoid resin material flowing into the hollow center bore **2*a* of the bobbin 2 upon the molding of resin material which will be described later, the other or lower opening 2*a*2 of bore 2*a* is closed by a lid 10 and an outer opening portion 4*a* of the core receiving member 4 (refer to FIG. 4) is closed by a cover plate 11, respectively. In order that the lid 10 can be easily broken, the portion of the lid 10 along the edge of the opening 2*a*2 of the bore 2*a* is made thin in thickness, while both side edge portions 11*a* and 11*b* of the cover plate 11 are protruded beyond both sides of the core receiving member 4 to be integral with the outer opening portion 4*a* thereof, and in order to remove the cover plate 11 from the outer opening portion 4*a* of member 4 easily, a groove 12 is formed on the cover plate 11** along the end edge of the outer opening portion 4*a*. Further, a projected surface 11*c* is formed on the outer surface of cover plate 11 on its central portion for positioning.

In FIG. 3, 13 designates a high voltage side bobbin on which a high voltage winding 14 is wound. Bobbin 13 has bored therethrough a hollow center bore 13*a* into which the low voltage side bobbin 2 with the low voltage winding 3 wound thereon is inserted. A plurality of flanges 15 are formed on the outer surface of the bobbin 13 with a predetermined distance between adjacent ones and the high voltage winding 14 is wound on the bobbin 13 and divided by a plurality of flanges 15. In this case, the divided winding portions of the winding 14 are connected in series by diodes (not shown).

For example, when a three-divided high voltage winding is formed, the first to third divided windings are sequentially wound on the bobbin 13 between the flanges 15. In this winding process, if the first and third divided windings are wound in the same direction but the intermediate winding, i.e., second divided winding, is wound in the opposite direction to the other divided windings, the distances between the winding end of the first divided winding and the beginning of the second divided winding and between the winding end of the second divided winding and the beginning of the third divided winding can be selected to be relatively long. Therefore, diodes which will connect the respective divided windings can be attached to the portion on which the second divided winding is wound, so that the high voltage side bobbin 13 can be made small in size. On the end edge portion of the bobbin 13 there is located a support 17 which will support a lead wire 16 which is in turn connected to the anode terminal of a cathode ray tube (not shown).

Figure 5:
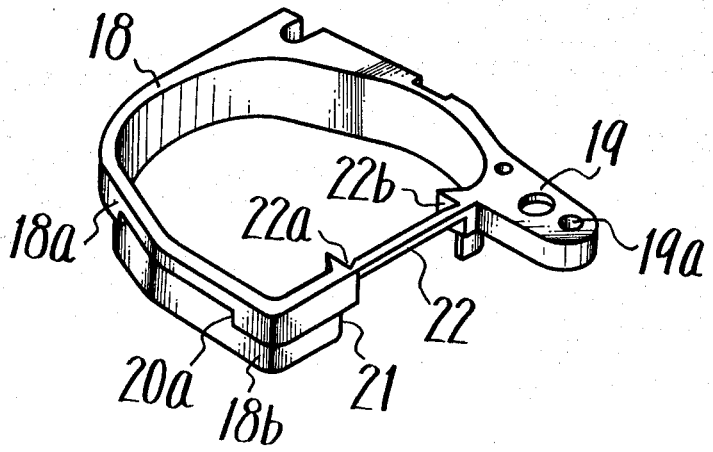
FIG. 5 is a perspective view showing a winding receiving frame.

In the figures, 18 designates a winding receiving frame which is fixed to one surface of a winding molding body A or its one side surface, on which the terminal pins 7 are planted, along its peripheral edge. As shown in FIG. 5, a half portion 18*a* of the peripheral surface of the frame 18 is selected to be thick in thickness, and a protrusion piece 19 is formed integral with a part of the thick half portion 18*a*. An aperture 19*a* for fixing to a machine chassis is bored through the protrusion piece 19. Recesses 20*a* and 20*b* are formed in the thick half portion 18*a* at its opposing sides from a thin half portion 18*b* of the frame 18. A cut-out portion 21 is formed on one side of the frame 18, i.e., one side where the recesses 20*a* and 20*b* are not formed, through which cut-out portion 21 the core receiving member 4 is inserted. A coupling piece 22 is used to couple both side edges of this cut-out portion 21 to make the winding receiving frame 18 a ring. Along both side edges of the coupling piece 22 there are formed grooves 22*a* and 22*b* to easily remove the coupling piece 22 from the frame 18.

In the figures, 23 denotes a cup-shaped molding box which is provided with, on its bottom surface at the central portion thereof, a positioning and supporting recess 24, with which the lower end of the low voltage side bobbin 21, i.e., lid 10 thereof, engages, and a bore 25 at the outer side of the recess 24 through which the support 17 for the lead wire 16 passes. A cylinder 26, through which the lead wire 16 passes, is provided on the lower surface of the molding box 23 in communication with the bore 25.

Figure 4:
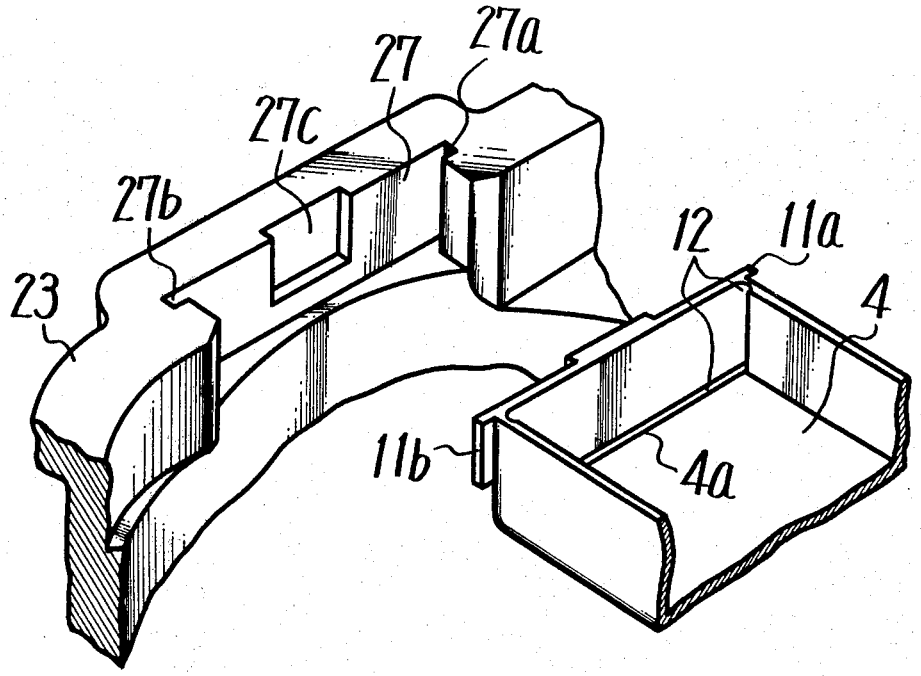
FIG. 4 is a perspective view showing, in an enlarged scale, an engaging portion between a low voltage side bobbin and a molding box.

As shown clearly in FIG. 4, an engaging recess 27, with which the outer end, i.e., cover plate 11, of the core receiving member 4 of low voltage side bobbin 2 engages, is formed on the inner surface of the upper opening of the molding box 23, and on both the side edges of the engaging recess 27 there are formed engaging grooves 27*a* and 27*b* with which the side edge portions 11*a* and 11*b* of the cover plate 11 engage, respectively. Further, on the central portion of the recess 27, there is formed a recess 27*c* with which the projected surface 11*c* of the cover plate 11 engages. The molding box 23 is formed by, for example, of an aluminum die casting.

Next, a description will be given on the assembling and molding of the winding portion of the fly-back transformer according to the present invention.

First, the low voltage side bobbin 2, on which the low voltage winding 3 is already wound, is inserted into the center hollow bore 13*a* of the high voltage side bobbin 13 on which the high voltage winding 14 is already wound, and then positioned and engaged by means of the engaging projection 9′ relative to the bobbin 13. Then, lead wire end portions 3*a* and 14*a* of both the windings 3 and 14 are connected to predetermined terminal pins 7 planted on the radial projections 5 around the protrusions 8. Thus, the composite winding body is formed. The composite winding body thus formed is then accommodated in the molding box 23, the lead wire 16 connected to the high voltage winding 14 together with the support 17 therefor of the bobbin 13 are both inserted into the bore 25, and the lead wire 16 is passed through the cylinder 26. Then, the cover plate 11 of the core receiving member 4 of the low voltage side bobbin 2 is engaged with the recess 27, the side edge portions 11*a* and 11*b* of the cover plate 11 are engaged with the grooves 27*a* and 27*b*, and the projecting surface 11*c* of the cover plate 11 is engaged with the recess 27*c*, respectively. While, the lid 10 of the bore 2*a* of bobbin 2 is engaged with the recess 24 of molding box 23. Thus, the composite winding body is positioned to the molding box 23 and then fixed thereto or engaged therewith.

Thereafter, the winding receiving frame 18 is engaged with the opening portion of molding box 23 in such a manner that the cut-out portion 21 of the frame 18 receives the core receiving member 4, the thin peripheral portion 18*b* of the frame 18 receives the outer periphery of box 23, and the thick peripheral portion 18*a* engages with the opening portion of box 23.

Then, resin material 28 is injected into the molding box 23 and heat-cured. Upon this injection of resin material 28, the hollow center bore 2*a* of the low voltage side bobbin 2 is closed at its one opening $2_{a2}$ by the lid 10 and at its other opening $2_{a1}$ by the core receiving member 4, and the opening portion 4*a* of the member 4 is closed by the cover plate 11, so that no resin material 28 leaks into the center bore 2*a* of bobbin 2. The cut-out portion 21 which is formed in the winding receiving frame 18, and both side edges of cut-out portion 21 are coupled by the coupling piece 22. Therefore, the winding receiving frame 18 is not deformed by the injection pressure of resin material 28.

After the injected resin material 28 has been hardened, the winding molded body is removed or released from the molding box 23, which is carried out in such a way that a tool (not shown) is hooked into the recesses 20*a* and 20*b* formed on the outer peripheral surface of the thick peripheral portion 18*a* of the winding receiving frame 18 and then raised or pulled up. Then, a tool (not shown) is inserted into the center bore 2*a* of the bobbin 2 of the winding molded body to break the lid 10 along its thin edge portion to complete the center bore 2*a,* the cover plate 11 of the core receiving member 4 is cut away along the side grooves 12, and further the coupling piece 22 of the winding receiving frame 18 is cut away along the side grooves 22*a* and 22*b*.

After the above processes have been carried out, the winding molded body A of the fly-back transformer according to the invention shown in FIG. 1 is obtained. Then the core 1 is inserted into the center bore 2*a* of the low voltage side bobbin 2 of the molded body through the core receiving member 4 to make the fly-back transformer.

In the above example of the invention, the high voltage winding is wound on the high voltage side bobbin as a plurality of divided windings, but the present invention can be, of course, applied to a case in which a high voltage winding is continuously wound.

As described above, according to the present invention, the winding receiving frame is integrally attached to the surface of the winding molded body on which the terminal pins are located, i.e., the upper peripheral edge portion thereof, so that no burrs protrude from the surface upon molding and the peripheral edge portion thereof which is the contact surface for the machine chassis, becomes flat and hence can be pisitively abutted against the machine chassis. Further, since the winding receiving frame is integrally provided with attaching means, the winding molded body or fly-back transformer can be easily and positively attached to the machine chassis without using any attaching tool. Also, during the manufacturing process of the fly-back transformer of this invention, burrs need not be trimmed, so that the working efficiency is greatly improved, and the fly-back transformer has a good appearance.

It will be apparent that many modifications and variations could be affected by one skilled in the art without departing from the spirit or scope of the novel concepts of the present invention, so that the spirit or scope of the invention should be determined by the appended claims.

We claim as our invention:

1. The method of making a fly-back transformer comprising the steps of:

mounting a first hollow cylindrical bobbin with a low voltage winding thereon within a second hollow cylindrical bobbin with at least one high voltage winding mounted thereon, connecting a plurality of input and output terminals to said low and high voltage windings, mounting a core receiving member having an integral cover plate over at least one end of said first bobbin, mounting said first and second bobbins, said core receiving member and said terminals in a mold, said mold, injecting thermal setting resin into said mold, removing said first and second bobbins, said core receiving member and said input and output terminals from said mold after said resin has set, removing said integral cover plate from said core receiving member, and attaching a generally C-shaped core to said first bobbin such that its open ends engage the ends of said first bobbin and said core receiving member.

* * * * *